US007547371B2

(12) United States Patent
Christensen et al.

(10) Patent No.: US 7,547,371 B2
(45) Date of Patent: Jun. 16, 2009

(54) COMPOSITE ARCHITECTURAL COLUMN

(75) Inventors: Jason Christensen, 275 N. 100 E., Fayette, UT (US) 84630; Roland J. Christensen, Fayette, UT (US)

(73) Assignee: Jason Christensen, Fayette, UT (US)

( * ) Notice: Subject to any disclaimer, the term of this patent is extended or adjusted under 35 U.S.C. 154(b) by 327 days.

(21) Appl. No.: 11/097,410

(22) Filed: Mar. 31, 2005

(65) Prior Publication Data

US 2006/0218873 A1 Oct. 5, 2006

(51) Int. Cl.
*B65H 81/00* (2006.01)
*B32B 37/00* (2006.01)

(52) U.S. Cl. ..... 156/171; 156/173; 156/190; 156/192

(58) Field of Classification Search ..... 156/148, 156/171, 172, 173, 175, 184, 187, 190, 192
See application file for complete search history.

(56) References Cited

U.S. PATENT DOCUMENTS 3,429,758 A * 2/1969 Young ..... 156/79
4,494,436 A * 1/1985 Kruesi ..... 156/148
5,127,307 A * 7/1992 Pimpis ..... 156/172
5,188,872 A * 2/1993 Quigley ..... 428/36.2
5,326,410 A * 7/1994 Boyles ..... 156/71
5,555,696 A 9/1996 Morrison, III et al.
5,692,351 A 12/1997 Morrison, III et al.
5,694,734 A * 12/1997 Cercone et al. ..... 52/745.17
5,704,187 A * 1/1998 Hosford et al. ..... 52/848
5,900,194 A 5/1999 Ashton
5,946,880 A 9/1999 Morrison, III et al.
6,367,225 B1 * 4/2002 Ashton ..... 52/834
2003/0143037 A1 * 7/2003 Ashton et al. ..... 405/250

* cited by examiner

*Primary Examiner*—Jeff H Aftergut
(74) *Attorney, Agent, or Firm*—Bryan G. Pratt; Rader, Fishman & Grauer PLLC

(57) ABSTRACT

An architectural column includes a tubular column body having a longitudinal axis extending from a first end to a second end, at least one inner layer, at least one support layer and at least one outer layer, wherein the support layer includes a composite fabric having fibers and a bonding resin.

16 Claims, 5 Drawing Sheets

COMPOSITE ARCHITECTURAL COLUMN

BACKGROUND

Architectural columns have long been used for structural support, aesthetic qualities, and artistic purposes. Architecturally correct columns have traditionally assumed a number of different forms. More specifically, traditional architectural columns have been made from wood, steel, concrete, or molded polymers. Recent developments in material processing have led to the use of fiber-reinforced composite materials in the formation of architectural columns. Conventional fiber-reinforced columns are made by a filament-winding process in which a band of fibers or filaments is wound around a rotating mandrel in a helical winding pattern and then cured to produce a structural column. In the helical winding process, the mandrel rotates while a fiber feed carriage traverses back and forth at a speed regulated to generate the desired helical angles. Since fibers provide the greatest compressive strength when oriented in the direction of the load, the helical winding pattern is manipulated to position the fibers as close to parallel with the longitudinal axis of the column as possible.

Unfortunately, using helical winding methods for the production of architectural columns is limited by a number of drawbacks. First, the glass fibers become very slippery when they are impregnated with wet resin. Consequently, the helical winding process mandates that the fibers be wound over the entire length of the mandrel to prevent the fibers from slipping or otherwise moving when winding relatively low angles. Second, by winding the fibers the entire length of the mandrel and around the end of the mandrel, the fiber material may sag between the impregnator and the pay-out eye as the fiber material is traversed back across the longitudinal axis of the mandrel. This sag often varies the orientation of the fibers laid down on the mandrel, thereby leading to lower strength and a rougher surface finish.

Additionally, the formation of architectural columns using helical winding methods produces significant amounts of wasted fiber and resin material. More specifically, the fiber material used in helical winding methods is wound around the ends of the mandrel In order to keep the fiber material on the mandrel secured at a low angle. Consequently, the entire length of the mandrel must be used, even if a shorter column length is desired. As a result, significant amounts of fiber material must then be removed from the formed column to achieve the desired size. Additionally, removal of the resulting helical wound column necessitates that the fiber material domes formed at the ends of the mandrel be cut off, thereby adding additional processing steps, increasing material waste, and increasing processing time and costs to the formation of the architectural column.

SUMMARY

In one of many possible embodiments, an architectural column includes a tubular column body having a longitudinal axis extending from a first end to a second end, at least one inner material layer, at least one compression support layer, and at least one outer material layer, wherein the compression support layer includes a composite fabric.

In another embodiment, a method of making an architectural column includes forming an inner layer, forming a support layer, and forming an outer layer, wherein the support layer includes a composite fabric having fibers and a bonding resin, and the column has a longitudinal axis extending from a first end to a second end.

In yet another embodiment, a method of making an architectural column includes forming a column body by filament-winding an inner layer around a mandrel, wrapping a composite fabric around the inner layer, and filament-winding an outer layer around the composite fabric.

BRIEF DESCRIPTION OF THE DRAWINGS

The accompanying drawings illustrate various embodiments of the present exemplary system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

An exemplary system and method for implementing an architectural column is disclosed herein. More specifically, a system and method are disclosed herein for forming an architectural column that is resistive to compressive loads by incorporating a unidirectional fabric. Numerous specific details are set forth below for purposes of explanation and to provide a thorough understanding of the present system and method.

In the following description, for purposes of explanation, numerous specific details are set forth in order to provide a thorough understanding of the present system and method for forming an architectural column. It will be apparent, however, to one skilled in the art, that the present method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 1:
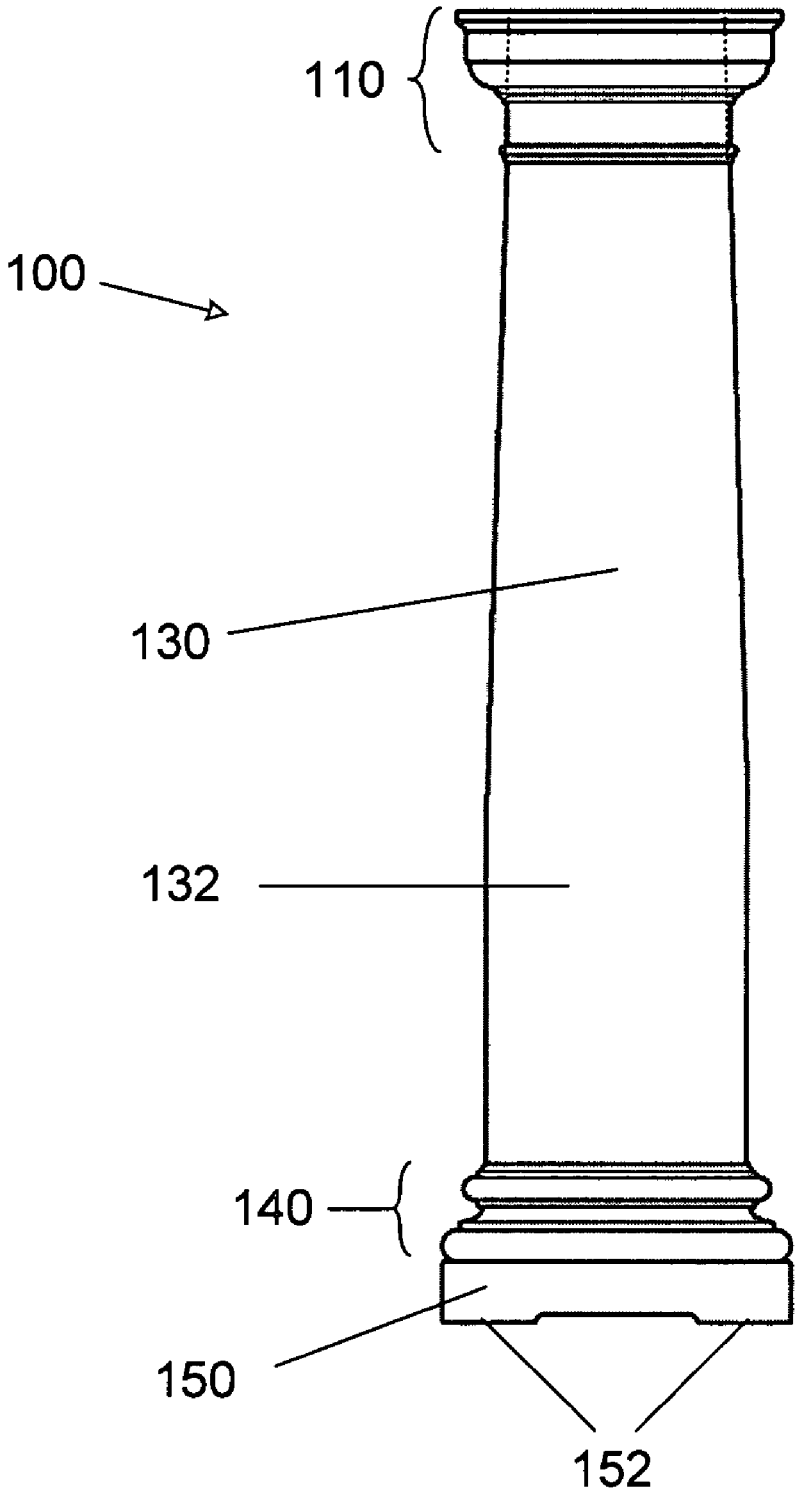
FIG. 1 is a perspective side view of an architectural column, according to one exemplary embodiment.

Referring now to FIG. 1, an embodiment of an architecturally correct column (100) is illustrated. As shown in FIG. 1, the architecturally correct column (100) may include a tubular column body (130) configured to provide axial load bearing support. The column (100) may also include a capital (110), a base (140), and a plinth (150). As illustrated in FIG. 1, the column body (130) is an elongate, tubular member. Additionally, according to one exemplary embodiment, the column body (130) may be coated with an outer surface material (132). The column body (130) generally includes a plurality of layers to provide strength, structure, and shape to the column body.

Figure 2A:
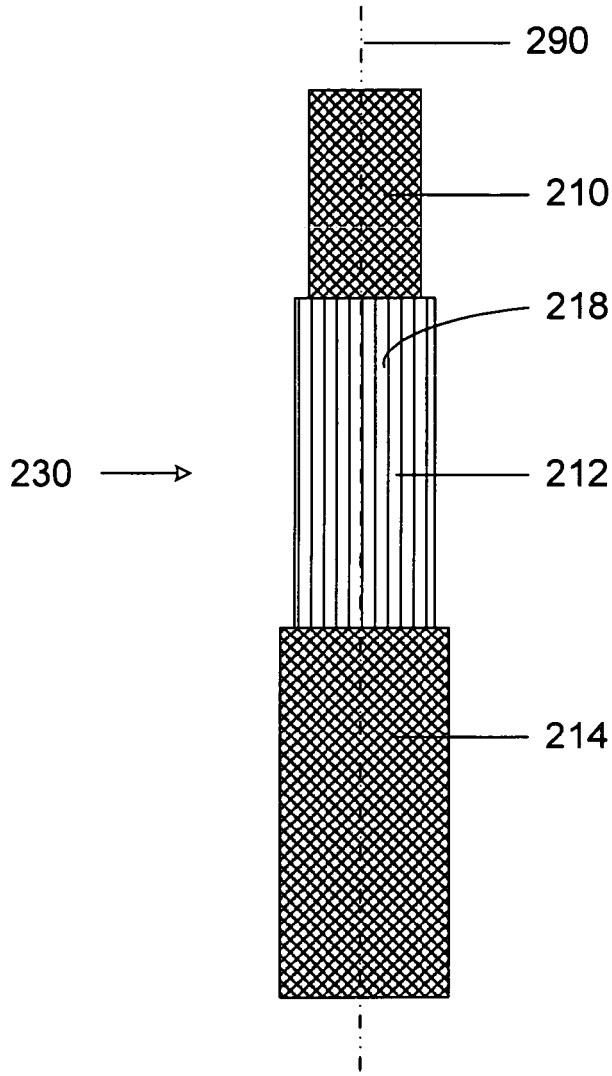
FIG. 2*a* illustrates a side view of a compression resistive column body, according to one exemplary embodiment.
Figure 2B:
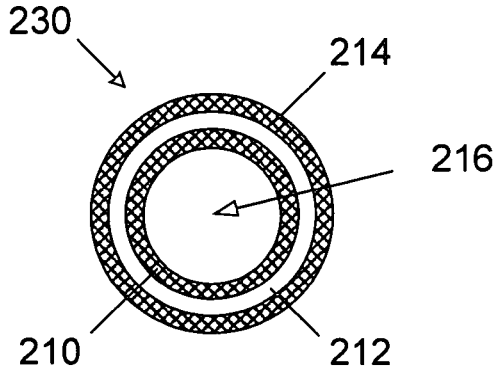
FIG. 2*b* is a top-view illustrating a cross-section of an architectural column body, according to one exemplary embodiment.

In one exemplary embodiment, as shown in FIGS. 2*a* and 2*b*, a column body (230) has an inner layer (210), a compression support layer (212), and an outer layer (214) extending along the longitudinal axis (290) of the column body (230). The core (216) of the column body (230) is generally hollow, but may be filled with any desired filler material including, but in no way limited to polymer foam. The inner layer (210) and outer layer (214) are configured to provide shape and structure to the column body (230) while the compression support layer (214) is configured to provide axial load bearing support.

According to one exemplary embodiment described herein, each of the above-mentioned layers is generally made from a fiber-reinforced composite material comprising a plurality of fibers reinforced with a bonding resin. Composite materials offer the unique ability to mix and match fibers and bonding resins to develop a material with specific desired properties. Suitable fibers for use in the composite material include, but are in no way limited to, steel, aluminum, ceramics, carbon, graphite, aramids, E-glass and S-glass fibers, other fibers known to those of skill in the art, or combinations thereof.

The bonding resin of the composite material maintains the structural integrity of the composite while providing the load transfer mechanism between the fibers that are incorporated into the structure. In addition to binding the composite structure together, the resin serves to provide corrosion resistance, protects the fibers from external damage, and contributes to the overall composite toughness from surface impacts, cuts, abrasion, and rough handling. Bonding resins come in a variety of chemical families, each designed to provide certain structural performance, cost and/or environmental resistance. Suitable resins include, but are not limited to, thermoset and thermoplastic resins. Examples of suitable thermoset resins include polyester, epoxy, vinyl ester, bisphenol-A fumarate, chlorendic and phenolic resins. Other suitable bonding resins include metal or ceramix matrices.

The bonding resin may also include one or more fillers and/or additives. Fillers are used to improve performance and reduce the cost of the composite material by lowering the cost of the significantly more expensive resin and imparting benefits such as shrinkage control, surface smoothness and crack resistance. Additives expand the usefulness of polymers, enhance their processability, and/or extend product durability.

According to one exemplary embodiment illustrated in FIGS. 2*a* and 2*b*, the inner layer (210) and outer layer (214) of the column body (230) are configured to maintain the shape of the architecturally correct column while resisting non-axial loads. However, according to one exemplary embodiment, a majority of the axial load resistance provided by the column body (230) is not provided by the inner layer (210) or the outer layer (214). Consequently, according to one exemplary embodiment, the fibers of the composite material used in the inner and outer layers (210, 214) may be oriented at any angle(s) relative to the longitudinal axis (290) of the column body (230). In other words, the fibers of the composite material used in the inner and outer layers may vary from a 0° orientation and, consequently, may avoid the generation of waste material and slipping on the mandrel. In one embodiment, the inner layer (210) and/or outer layer (214) of the column body (230) are filament-wound with a helical winding pattern. In another embodiment, the inner and/or outer layer(s) are filament-wound with a hoop winding pattern. Alternatively, these layers may also be augmented with any number of circumferential windings or windings of various orientations.

Continuing with FIG. 2, the support layer (212) is configured to bear a majority of the axial loads born by the column body (230). According to one exemplary embodiment, the axial loads born by the support layer (212) include, but are in no way limited to compressive axial loads typically supported during architectural column use. According to the present exemplary embodiment, the illustrated support layer (212) is made from a composite fabric, an assembly of long fibers produced into a flat sheet of one or more layers of fibers. These fibers and/or layers are held together either by mechanical interlocking of the fibers themselves or with a secondary bonding agent that bonds the fibers together and holds them in place, to form a prepreg. Fabric types are categorized by the orientation of the fibers used, and by the various construction methods used to hold the fibers together. Suitable composite fabrics that may be used for the support layer (212) include, but are in no way limited to, unidirectional fabrics, woven fabrics, multi-axial fabrics, hybrid fabrics, and other fabrics known to those of skill in the art.

In one exemplary embodiment, the support layer (212) comprises a unidirectional (UD) fabric or a fabric in which a majority of the fibers are aligned in the same direction. The UD fabric (218) may also contain a small amount of fiber or other material aligned in other directions to hold the primary fibers in position, although the other fibers may also offer some structural properties. In one exemplary embodiment, the UD fabric (218) comprises a 0°/90° fabric having approximately 75% of the fibers by weight aligned in one direction. In yet another exemplary embodiment, the UD fabric (218) has approximately 90% of the fibers by weight aligned in one direction. According to these exemplary embodiments, UD fibers are straight and uncrimped. Consequently, using a UD fabric offers the ability to place fibers in the column body (230) where they are most beneficial, in the optimum quantity (no more or less than required), and at the desired angle. More specifically, according to one exemplary embodiment, any range of fibers of the UD fabric (218) may be oriented with regards to a single desired axis including, but not limited to, as low as approximately 10% to 25% of the fibers by weight up to approximately 75% or 90% of the fibers by weight, depending on the fabric used.

According to one exemplary embodiment, the UD fabric (218) forming the support layer (212) comprises a weft UD fabric in which the primary fibers are aligned at substantially 90° relative to the length of the fabric roll. As a result, when used as the composite fabric for the support layer (212), a weft UD fabric yields a support layer (212) with a majority of the fibers oriented at substantially 0° relative to the longitudinal axis (290) of the column body (230). According to one exemplary embodiment, the use of a weft UD fabric yields a support layer (212) with a majority of the fibers oriented between approximately 0° and approximately 20° relative to the longitudinal axis (290) of the column body (230). This configuration provides superior axial load bearing strength, due to fiber orientation, when compared to traditional helically wound columns in which the fibers are typically oriented at about 30° or greater relative to the longitudinal axis of the column.

In another exemplary embodiment, the composite fabric of the support layer (212) comprises a woven fabric. Woven fabrics are produced by the interlacing of warp (0° relative to the fabric roll length) fibers and weft (90°) fibers in a regular pattern or weave style. The fabric's integrity is maintained by the mechanical interlocking of the fibers. Due to the presence of the weft fibers, the woven fabric also provides superior axial load bearing strength when compared to traditional helically wound columns. In another embodiment the composite fabric comprises a multi-axial fabric, or a fabric having one or more layers of long fibers held in place by a secondary non-structural stitching thread. The main fibers can be any of the above-mentioned structural fibers available in any combination. The stitching process incorporated by the multi-axial fabric allows a variety of fiber orientations, beyond the simple 0/90° of woven fabrics, to be combined into one fabric.

In another embodiment the composite fabric of the support layer (212) comprises a hybrid fabric, a fabric having more than one type of structural fiber in its construction. The incorporation of a hybrid fabric allows two fibers to be presented in just one layer of fabric rather than two. In one embodiment a woven hybrid has one fiber running in the weft direction and the second fiber running in the warp direction. In another embodiment the hybrid fabric includes alternating threads of each fiber in each warp/weft direction. Although hybrids are most commonly found in 0/90° woven fabrics, they may also be used in 0/90° stitched, unidirectional, and/or multi-axial fabrics.

Figure 3:
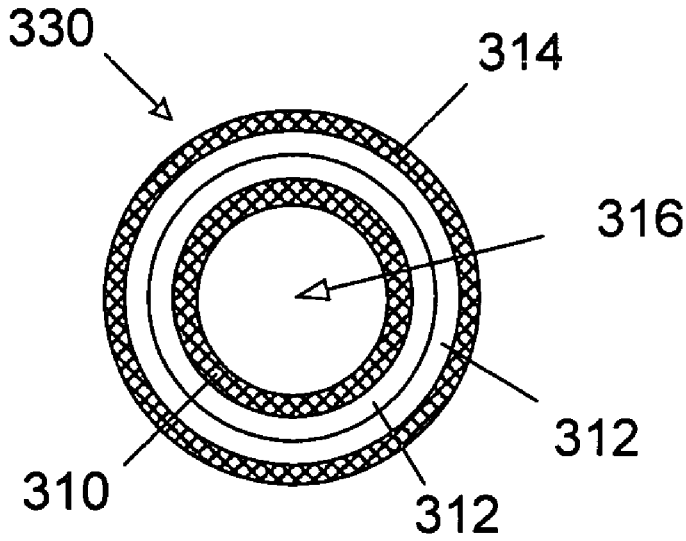
FIG. 3 is a top-view illustrating a cross-section of an architectural column body, according to another exemplary embodiment.
Figure 4:
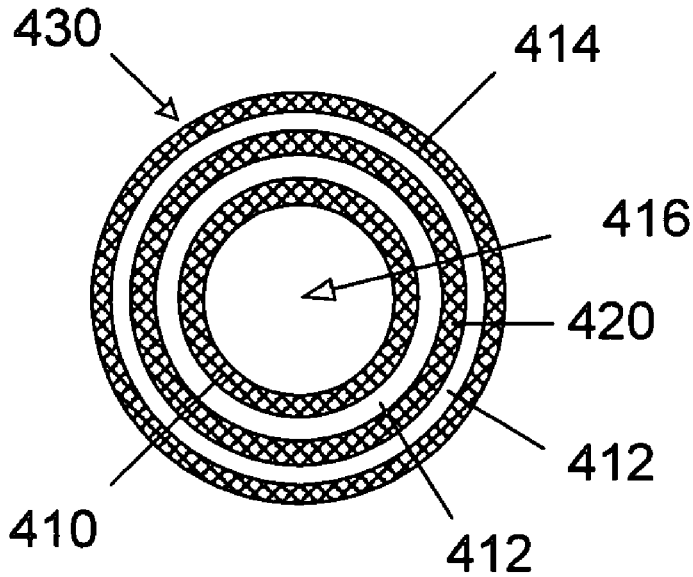
FIG. 4 is a top-view illustrating yet another cross-section of an architectural column body, according to one exemplary embodiment.

Generally, the fiber-reinforced column body is not limited to the embodiments described above, but may include any number of inner and outer layers and support layers. Additional layers may use different composite materials, fabrics, winding patterns, fiber orientations, fibers, bonding agents, or combinations thereof. For example, FIG. 3 depicts a cross-sectional pattern of an exemplary embodiment of a column body (330) having an inner layer (310) followed by two or more support layers (312), followed by an outer layer (314). The inner and outer layers may be made in any of the manners described above for the inner layer and outer layer. In another embodiment, shown in FIG. 4, the column body (430) has at least one inner layer (410), at least one outer layer (414), and two or more support layers (412). A hoop or helically-wound non-support layer (420) is located between the two support layers (412). Again, the column is not limited to the embodiment described above, but may contain any combination or variation desirable in accordance with the principles described herein.

Referring again to the exemplary embodiment of FIG. 1, the column also includes an outer surface material (132) surrounding the column body (130). Suitable surface materials include thermoset polymers, fiberglass, a cement, plaster, synthetic wood, metals, Formica, fabrics and other surface coverings known to those of skill in the art. Generally, the surface (132) may either be smooth or fluted as desired to conform to a desired architectural design. The surface (132) is not limited to these embodiments, but may contain any other design or shape desirable. The column (100) may also be tapered, such as in accordance with Greco-Roman architectural orders. The specific proportions and degrees of taper may vary, depending on the style of column (100) desired. In one exemplary embodiment, a lower third of the column body (130) is characterized by an absence of substantial taper, while the majority of the tapering occurs in the upper half of the column body (130).

In one embodiment, the taper of the column (100) may be achieved by forming the column body (130) with the desired taper and applying a surface material (132) of uniform thickness over the column body (130). A method of forming the column body (130) is described in more detail below. In another embodiment, the taper may be achieved by forming a column body (130) of uniform diameter from top to bottom and coating the column body (130) with a surface material having a thickness that decreases from the bottom toward the top of the column body (130). The taper may also be achieved by a combination of the above methods, or by any other method known to those of skill in the art.

The column (100) may also include a base (140) and/or plinth (150). The decorative base (140) the column (100) helps to define the order or style of the column (100). The base (140), along with the capital (110) and the column body (130), gives the column (100) its own distinctive character. The base (140) is typically round with various designs and moldings. The base (140) rests on the plinth (150), generally a square or rectangular block or slab with short legs (152). The plinth (150) provides an interface between the base (140) and the ground or floor, and can be designed to raise the column body (130) off the ground to allow air to circulate in the interior of the column (100). The base (140) and plinth (150) can be molded in one piece or may constitute separate pieces, but generally are formed independent of the column body (130).

Figure 5:
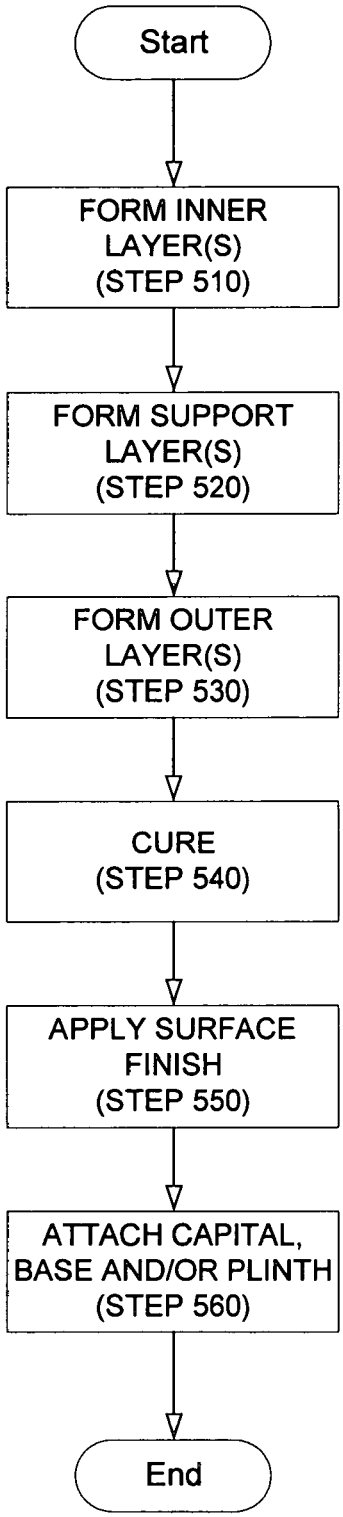
FIG. 5 is a flowchart illustrating a method of making an architectural column, according to one exemplary embodiment.

Referring now to FIG. 5, an exemplary embodiment of a method of making an exemplary column and/or column body is shown. The method comprises first forming one or more inner layers (step 510). Next, one or more support layers is formed over the inner layer(s) (step 520), after which one or more outer layer(s) is formed over the support layer (step 530). After all layers are formed, the column body structure is then cured (step 540). A surface finish may then be applied to the outer layer (step 550), and a capital, base and plinth may also be attached to the column body (step 560). The steps of this method will be described in more detail below.

Figure 6A:
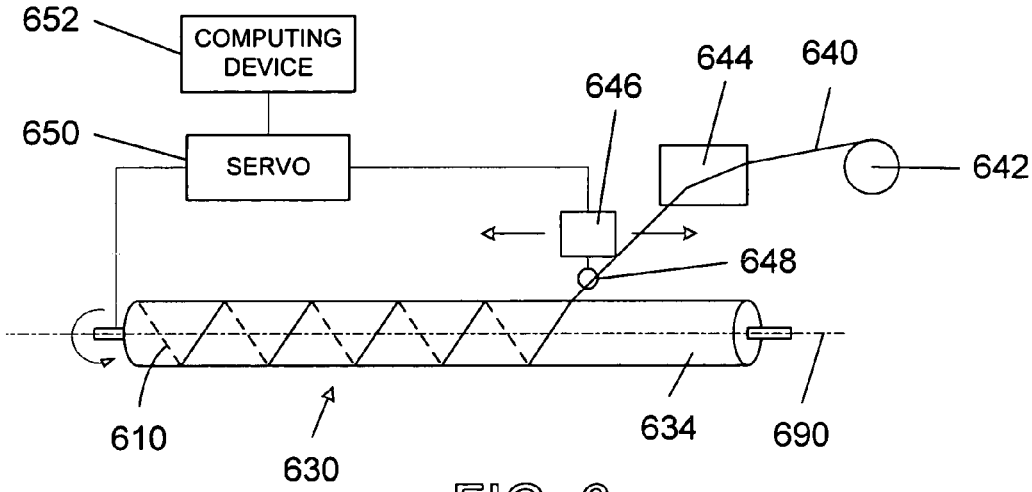
FIGS. 6*a*-6*c* are simple perspective views illustrating steps in the formation of an architectural column body, according to one exemplary embodiment.

As illustrated in FIG. 5, the first step of the exemplary method is to form the inner layer(s) (step 510). According to one exemplary embodiment, the inner layer(s) can be formed by filament-winding techniques known to those of skill in the art. Referring to FIG. 6*a*, an inner layer (610) may formed by winding a continuous band of fiber tows or rovings ("fibers") (640) on a mandrel (634). The fibers (640) may be helically wound, hoop wound, or polar wound, and may also include subsequent circumferential windings.

As illustrated in FIG. 6A, an exemplary system for forming the present exemplary column body includes a computing device (652) controllably coupled through a servo mechanism (650) to a moveable carriage (646) and a rotatable mandrel (634). Fibers (640) are payed off from a fiber creel (642) and passed through a resin bath (644) to impregnate the fibers (640) with a bonding resin. The impregnated fibers (640) then pass through a pay-out eye (648) of the carriage (646) and onto the mandrel (634). As the mandrel (634) rotates, the carriage (646) traverses the length of the mandrel (634) in both directions, thereby depositing the fibers (640) on the mandrel (634) in a hoop or helical pattern. The angle of the wound fibers (640) can be controlled by the rotation speed of the mandrel (634) and/or speed of the carriage (646), both of which can be controlled by the computing device (652) and servo (650). In one exemplary embodiment the winding comprises wet-winding in which the fibers (640) pass through a resin bath (644) and are then wound onto the mandrel (634). In another exemplary embodiment the winding comprises a prepreg winding in which the fibers (640) on the creel (642) have been pre-impregnated with the bonding resin; thus, these fibers do not pass through the resin bath (644).

Figure 6B:
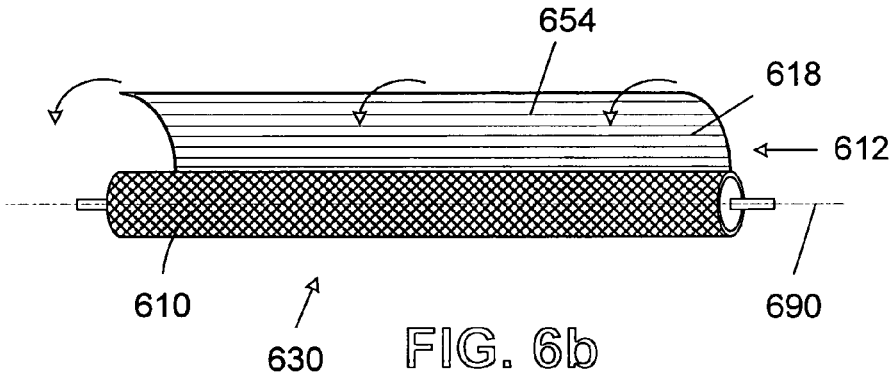
Figure 6C:
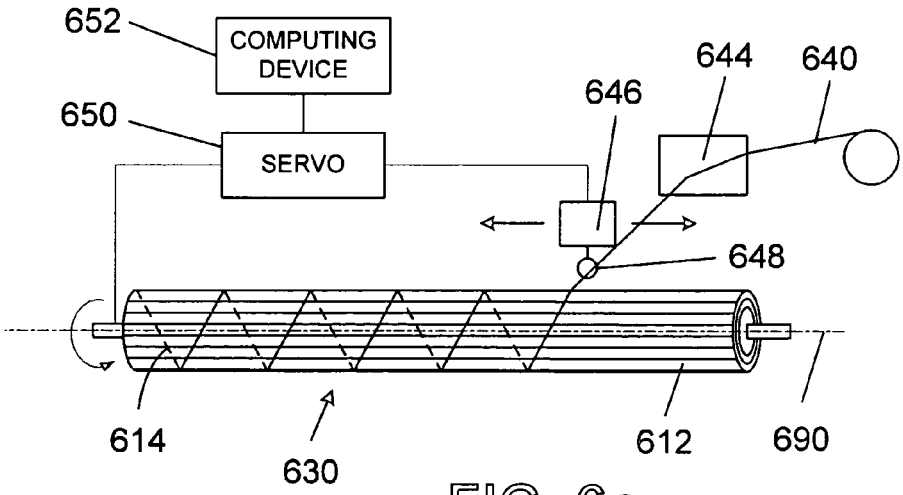

As shown in FIG. 6*b*, the support layer(s) (612) is formed (step 520; FIG. 5) directly over the inner layer(s) (610) by wrapping a composite fabric (618) over the inner layer(s) (610) such that the majority of the fibers (654) in the fabric (618) are oriented between approximately 0° and 20° relative to the longitudinal axis (690) of the column body (630). In one embodiment the fabric (618) has substantially the same length as the desired column body (630) and a width substantially equal to the circumference of the outer surface of the inner layer (610), thereby causing the fabric (618) to surround substantially the entire circumference of the inner layer (610) without creating a ridge or gap at the seam. According to another exemplary embodiment, the fabric (618) has a width greater than the circumference of the outer surface of the inner layer (610), thereby allowing the fabric (618) to overlap itself and create a thicker layer or multiple layers. Since wrapping the fabric (618) does not require winding about the mandrel (634), a support layer (612) may be constructed rapidly with the fibers oriented at approximately 0° relative to the longitudinal axis (690) of the column body (630).

In one exemplary embodiment, the fabric (618) may be pre-impregnated with a bonding resin such that the fabric (618) may omit passing through a resin bath prior to wrapping over the inner layer (610). In another embodiment, the fabric (618) is wet-wrapped around the inner layer (610) by either passing the fabric (618) through a resin bath (not shown) before wrapping it around the inner layer (610), or by wrapping the fabric (618) around the inner layer (610) and then coating it with a bonding resin. The fabric (618) may be coated with the bonding resin by any means, such as with a brush, squeegee, rag, cloth, roller, or any other means known to those of skill in the art.

After the support layer(s) (612) has been formed around the inner layer(s) (step 520; FIG. 5), the outer layer(s) (614) is formed around the support layer(s) (step 530; FIG. 5). The outer layer(s) (614) can be formed according to any of the above-mentioned manners for forming the inner layer(s) (610).

Once the layers are deposited, the composite column is cured (step 540; FIG. 5). According to one exemplary embodiment, the layered composite column body (630) can be cured by any means known to those of skill in the art, including, but in no way limited to, light curing, heat curing, vacuum curing, pressure-curing, electron beam curing, and/or combinations thereof. In one exemplary embodiment the column body (630) is cured by removing it and the mandrel (634) from the filament-winding machine and placing them into an autoclave, oven, or other heater for heat curing.

With the column body (630) cured (step 540; FIG. 5), a surface finish may be applied (step 550; FIG. 5) thereto. As mentioned previously, the surface finish applied to the present column body (630) may include, but are in no way limited to, the application of thermoset polymers, fiberglass, a cement, plaster, synthetic wood, metals, Formica, and/or fabrics, either applied mechanically or by hand. Upon completion of the surface finish (step 550; FIG. 5), the structural column may be completed by attaching a capital, base, and/or plinth (step 560; FIG. 5). Alternatively, the completed structural columns may be stacked within each other to minimize space during transportation.

In conclusion, the structure of the composite column body described above permits the quick and efficient manufacture of lightweight architectural columns having substantial load-bearing capacities. The column and methods of making it reduce fiber and resin waste, cut processing times, and reduce overall costs compared to traditional helical wound structures.

The preceding description has been presented only to illustrate and describe exemplary embodiments of the present system and method. It is not intended to be exhaustive or to limit the system and method to any precise form disclosed. Many modifications and variations are possible in light of the above teaching. It is intended that the scope of the system and method be defined by the following claims.

What is claimed is:

1. A method of making an architectural column, comprising:

forming an inner layer of a column body about a mandrel;

forming a support layer of a column body around said inner layer;

forming an outer layer of a column body around said support layer; and removing said mandrel;

wherein said support layer comprises a composite fabric having fibers and a bonding resin, said support layer comprising of a pre-manufactured sheet of composite fabric, and wherein said column has a longitudinal axis extending from a first end to a second end;

wherein said composite fabric support layer has a length substantially equal to a length of said architectural column; and wherein said fabric has a width substantially equal to a circumference of an outer surface of said inner layer wherein said composite fabric forms the support layer without creating a ridge or gap at a seam.

2. The method of claim 1, wherein said composite fabric comprises a unidirectional fabric.

3. The method of claim 2, wherein said unidirectional fabric comprises a weft unidirectional fabric.

4. The method of claim 2, wherein a majority of said composite fabric fibers are aligned between approximately 0° and 20° relative to said longitudinal axis.

5. The method of claim 1, wherein said inner layer and said outer layer are formed via filament-winding.

6. The method of claim 5, wherein said filament-winding comprises one of hoop winding, helical winding, or polar winding.

7. The method of claim 5, wherein said filament-winding comprises prepreg or wet-winding.

8. The method of claim 1, wherein said support layer is formed by wrapping said composite fabric around said inner layer.

9. The method of claim 8, further comprising coating said composite fabric with a bonding resin.

10. The method of claim 8, wherein said outer layer is formed around said support layer.

11. The method of claim 1, further comprising curing said inner layer, said support layer, and said outer layer.

12. A method comprising:

forming a column body including filament-winding an inner layer around a mandrel, wrapping a pre-manufactured sheet of composite fabric around said inner layer, and filament-winding an outer layer around said composite fabric; and removing said mandrel;

wherein said composite fabric includes fibers and a bonding resin;

wherein said composite fabric has a length substantially equal to a length of said column body;

wherein said fabric has a width substantially equal to a circumference of an outer surface of said inner layer wherein said fabric is wrapped such that a ridge or gap is not created at a seam.

13. The method of claim 12, wherein said composite fabric comprises a unidirectional fabric.

14. The method of claim 13, wherein a majority of said composite fabric fibers are aligned between approximately 0° and 20° relative to a longitudinal axis of said column body.

15. The method of claim 12, further comprising:

curing said column body; and removing said column body from said mandrel.

16. The method of claim 12, further comprising:

applying an outer surface to said column body; and attaching a base, a plinth, or a capital to said column body.

* * * * *